US009255449B2

(12) United States Patent
Schwefe et al.

(10) Patent No.: US 9,255,449 B2
(45) Date of Patent: Feb. 9, 2016

(54) DRILL BIT WITH ELECTROHYDRAULICALLY ADJUSTABLE PADS FOR CONTROLLING DEPTH OF CUT

(75) Inventors: Thorsten Schwefe, Virginia Water (GB); Dan Raz, Tirat Carmel (IL); Gregory Rinberg, Tirat Carmel (IL); Mark Bruk, Tirat Carmel (IL)

(73) Assignee: Baker Hughes Incorporated, Houston, TX (US)

( * ) Notice: Subject to any disclaimer, the term of this patent is extended or adjusted under 35 U.S.C. 154(b) by 737 days.

(21) Appl. No.: 13/561,743

(22) Filed: Jul. 30, 2012

(65) Prior Publication Data

US 2014/0027179 A1 Jan. 30, 2014

(51) Int. Cl.
*E21B 10/62* (2006.01)

(52) U.S. Cl.
CPC ..... *E21B 10/62* (2013.01)

(58) Field of Classification Search
CPC ..... E21B 10/20; E21B 10/26; E21B 10/322; E21B 10/325; E21B 10/40; E21B 10/42; E21B 7/00; E21B 7/04; E21B 7/06
See application file for complete search history.

(56) References Cited

U.S. PATENT DOCUMENTS

| | | | | |
|---|---|---|---|---|
| 1,860,214 | A | | 5/1932 | Yeaman |
| 3,493,165 | A | | 2/1970 | Schonfeld |
| 3,807,512 | A | | 4/1974 | Pogonowski et al. |
| 4,185,704 | A | | 1/1980 | Nixon, Jr. |
| 4,281,722 | A | | 8/1981 | Tucker et al. |
| 4,397,619 | A | | 8/1983 | Alliquander et al. |
| 4,549,614 | A | | 10/1985 | Kaalstad et al. |
| 4,676,310 | A | | 6/1987 | Scherbatskoy et al. |
| 4,940,097 | A | | 7/1990 | Martini |
| 5,086,645 | A | * | 2/1992 | Deaton ..... 73/152.17 |
| 5,582,260 | A | | 12/1996 | Murer et al. |
| 5,682,957 | A | | 11/1997 | Lyon |
| 5,971,085 | A | | 10/1999 | Colebrook |
| 6,116,354 | A | | 9/2000 | Buytaert |
| 7,004,263 | B2 | | 2/2006 | Moriarty et al. |
| 7,198,119 | B1 | | 4/2007 | Hall et al. |
| 7,360,610 | B2 | | 4/2008 | Hall et al. |
| 7,389,832 | B2 | | 6/2008 | Hooper et al. |
| 7,434,634 | B1 | | 10/2008 | Hall et al. |
| 7,451,835 | B1 | | 11/2008 | Hall et al. |
| 7,484,576 | B2 | | 2/2009 | Hall et al. |
| 7,506,701 | B2 | | 3/2009 | Hall et al. |
| 7,866,416 | B2 | | 1/2011 | Hall et al. |
| 8,011,457 | B2 | | 9/2011 | Hall et al. |
| 8,297,375 | B2 | | 10/2012 | Hall et al. |
| 2002/0179336 | A1 | | 12/2002 | Schaaf et al. |
| 2005/0247488 | A1 | | 11/2005 | Mock et al. |

(Continued)

OTHER PUBLICATIONS

International Search Report and Written Opinion dated Nov. 5, 2013 for International Application No. PCT/US2013/052621.

(Continued)

*Primary Examiner* — Shane Bomar
*Assistant Examiner* — Wei Wang
(74) *Attorney, Agent, or Firm* — Cantor Colburn LLP

(57) ABSTRACT

A drill bit is disclosed that in one embodiment includes a pad configured to extend and retract from a surface of the drill bit, a motor, a linearly movable member coupled to the motor, a hydraulic unit configured to apply force on the pad, and wherein motion of the motor in a first direction causes the linearly movable member in a first direction to cause the hydraulic unit to exert a force on the pad to extend the pad.

12 Claims, 3 Drawing Sheets

(56) References Cited

U.S. PATENT DOCUMENTS

| | | | |
|---|---|---|---|
| 2007/0114062 | A1 | 5/2007 | Hall et al. |
| 2007/0114068 | A1 | 5/2007 | Hall et al. |
| 2007/0181298 | A1 | 8/2007 | Sheiretov et al. |
| 2008/0179098 | A1 | 7/2008 | Hall et al. |
| 2008/0308318 | A1 | 12/2008 | Moore |
| 2009/0044979 | A1 | 2/2009 | Johnson et al. |
| 2009/0057016 | A1 | 3/2009 | Hall et al. |
| 2009/0107722 | A1 | 4/2009 | Chen et al. |
| 2009/0318803 | A1 | 12/2009 | Abe et al. |
| 2010/0071956 | A1 | 3/2010 | Beuershausen |
| 2010/0212966 | A1 | 8/2010 | Hall et al. |
| 2011/0031025 | A1 | 2/2011 | Kulkami et al. |
| 2011/0120775 | A1 | 5/2011 | Krueger et al. |
| 2014/0027177 | A1 | 1/2014 | Schwefe et al. |
| 2014/0027179 | A1 | 1/2014 | Schwefe et al. |
| 2014/0027180 | A1 | 1/2014 | Schwefe |

OTHER PUBLICATIONS

International Search Report and Written Opinion dated Oct. 23, 2013 for International Application No. PCT/US2013/052615.

International Search Report and Written Opinion dated Oct. 23, 2013 for International Application No. PCT/US2013/052616.

International Search Report and Written Opinion dated Oct. 25, 2013 for International Application No. PCT/US2013/052619.

* cited by examiner

DRILL BIT WITH ELECTROHYDRAULICALLY ADJUSTABLE PADS FOR CONTROLLING DEPTH OF CUT

BACKGROUND INFORMATION

1. Field of the Disclosure

This disclosure relates generally to drill bits and systems that utilize the same for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA") attached at end thereof. The BHA typically includes devices and sensors that provide information relating to a variety of parameters relating to the drilling operations ("drilling parameters"), behavior of the BHA ("BHA parameters") and the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. During drilling, a drilling fluid is supplied under pressure to the tubular that discharges at the drill bit bottom and returns to the surface via an annulus between the drill string and the formation. A large number of wellbores are drilled along contoured trajectories. For example, a single wellbore may include one or more vertical sections, deviated sections and horizontal sections through differing types of rock formations. Rate of penetration (ROP) of the drill bit is an important parameter relating to efficient drilling of the wellbore and depends largely on the weight-on-bit (WOB) and rotational speed (revolutions per minute or "RPM") of the drill bit. The drilling operator controls WOB by controlling the hook load on the drill bit and RPM by controlling the rotation of the drill string at the surface and/or the mud motor in the BHA (if one is provided). Drillers attempt to obtain high ROP while avoiding high drill bit fluctuations. The drill bit, however, often experiences high fluctuations and controlling the drill bit fluctuations and ROP by such methods requires the drilling system or operator to take actions at the surface. The impact of such surface actions on the drill bit fluctuations is not substantially immediate. For a given WOB and ROP of the drill bit, aggressiveness of the drill bit contributes to the drill bit fluctuations. Aggressiveness of the drill bit can be controlled by controlling the depth of cut of the drill bit and thus the excessive drill bit fluctuations.

The disclosure herein provides a drill bit configured to control the aggressiveness of a drill bit and a drilling system using the same for drilling wellbores.

SUMMARY

In one aspect, a drill bit is disclosed that in one embodiment includes a pad configured to extend and retract from a surface of the drill bit, a motor, a linearly movable member coupled to the motor, a hydraulic unit configured to apply force on the pad, and wherein motion of the motor in a first direction causes the linearly movable member in a first direction to cause the hydraulic unit to exert a force on the pad to extend the pad.

In another aspect, a method of drilling a wellbore is disclosed that in one embodiment includes conveying a drill string in wellbore that includes a drill bit configured to drill the wellbore, wherein the drill bit further comprises a pad configured to extend and retract from a face of the drill bit, a motor, a linearly movable member coupled to the motor, a hydraulic unit configured to apply force on the pad, and wherein motion of the motor in a first direction causes the linearly movable member in a first direction to cause the hydraulic unit to exert a force on the pad to extend the pad; and rotating the drill bit to drill the wellbore. In yet another aspect, the method may further include adjusting the force on the pad in response to a parameter of interest determined during drilling of the wellbore. The parameter of interest may be one of: (i) vibration; (ii) lateral movement of the drilling assembly or the drill bit; (iii) whirl; (iv) bending moment; (v) acceleration; and (vi) stick-slip.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
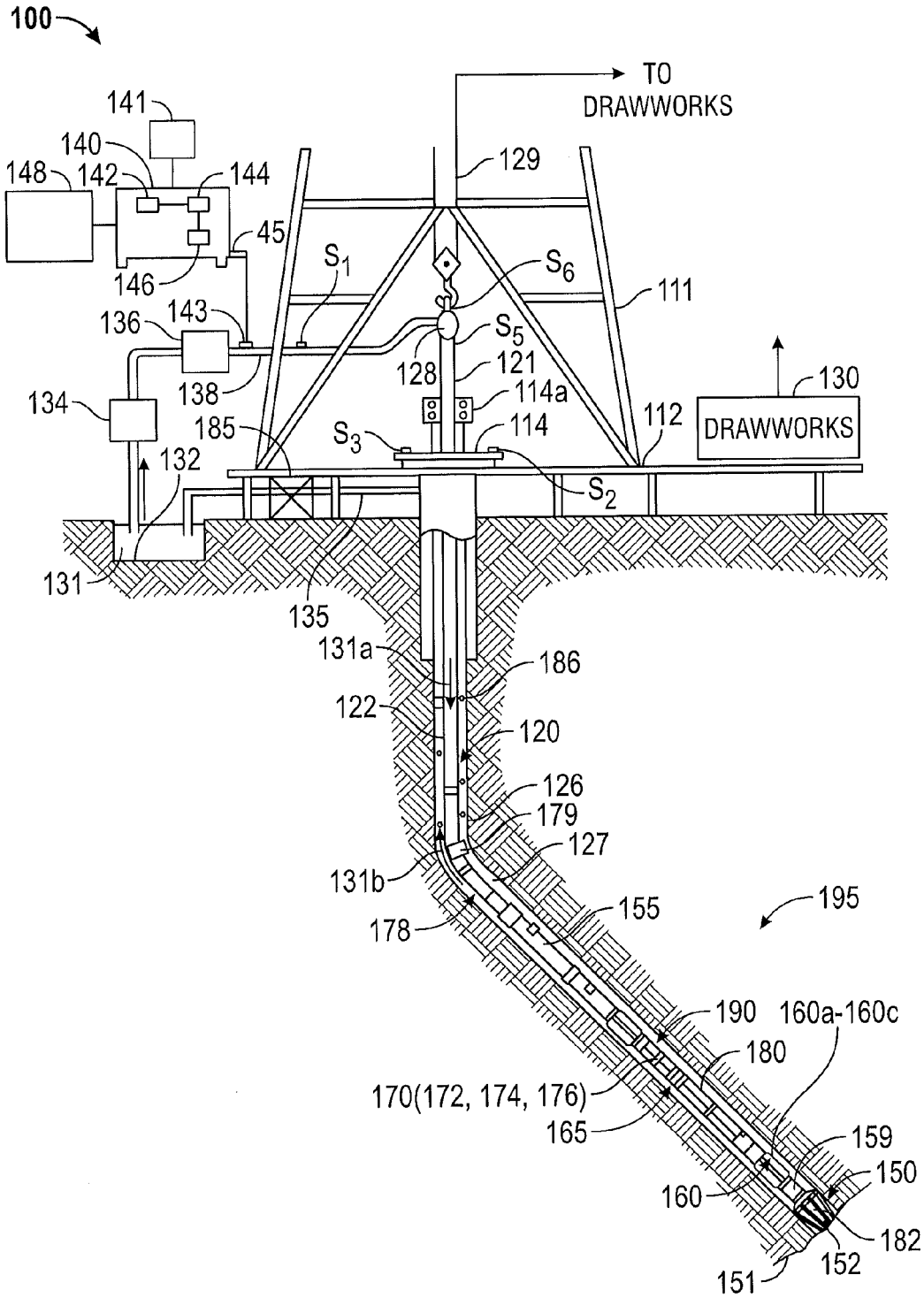
FIG. 1 is a schematic diagram of an exemplary drilling system that includes a drill string that has a drill bit made according to one embodiment of the disclosure.

FIG. 1 is a schematic diagram of an exemplary drilling system 100 that includes a drill string 120 having a drilling assembly or a bottomhole assembly 190 attached to its bottom end. Drill string 120 is shown conveyed in a borehole 126 formed in a formation 195. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to the drilling assembly 190, disintegrates the geological formation 195. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

To drill the wellbore 126, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* discharges at the borehole bottom 151 through openings in the drill bit 150. The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation. A surface control unit or controller 140 receives: signals from the downhole sensors and devices via a sensor 143 placed in the fluid line 138; and signals from sensors $S_1$-$S_6$ and other sensors used in the system 100 and processes such signals according to programmed instructions provided to the surface control unit 140. The surface control unit 140 displays desired drilling parameters and other information on a display/monitor 141 for the operator. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations drilling operations.

The drilling assembly 190 may also contain formation evaluation sensors or devices (also referred to as measurement-while-drilling (MWD) or logging-while-drilling (LWD) sensors) for providing various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly 190 (including, but not limited to, velocity, vibration, bending moment, acceleration, oscillation, whirl, and stick-slip) and drilling operating parameters, including, but not limited to, weight-on-bit, fluid flow rate, and rotational speed of the drilling assembly.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit along any particular direction. A control unit 170 processes data from downhole sensors and controls operation of various downhole devices. The control unit includes a processor 172, such as microprocessor, a data storage device 174, such as a solid-state memory and programs 176 stored in the data storage device 174 and accessible to the processor 172. A suitable telemetry unit 179 provides two-way signal and data communication between the control units 140 and 170.

During drilling of the wellbore 126, it is desirable to control aggressiveness of the drill bit to drill smoother boreholes, avoid damage to the drill bit and improve drilling efficiency. To reduce axial aggressiveness of the drill bit 150, the drill bit is provided with one or more pads 180 configured to extend and retract from the drill bit surface 152. A force application device or unit 185 in the drill bit adjusts the extension of the one or more pads 180, which controls the depth of cut of the cutters on a drill bit surface, such as the face, thereby controlling the axial aggressiveness of the drill bit 150. An exemplary force application device for controlling the drill bit aggressiveness is described in reference to FIGS. 2-3.

Figure 2:
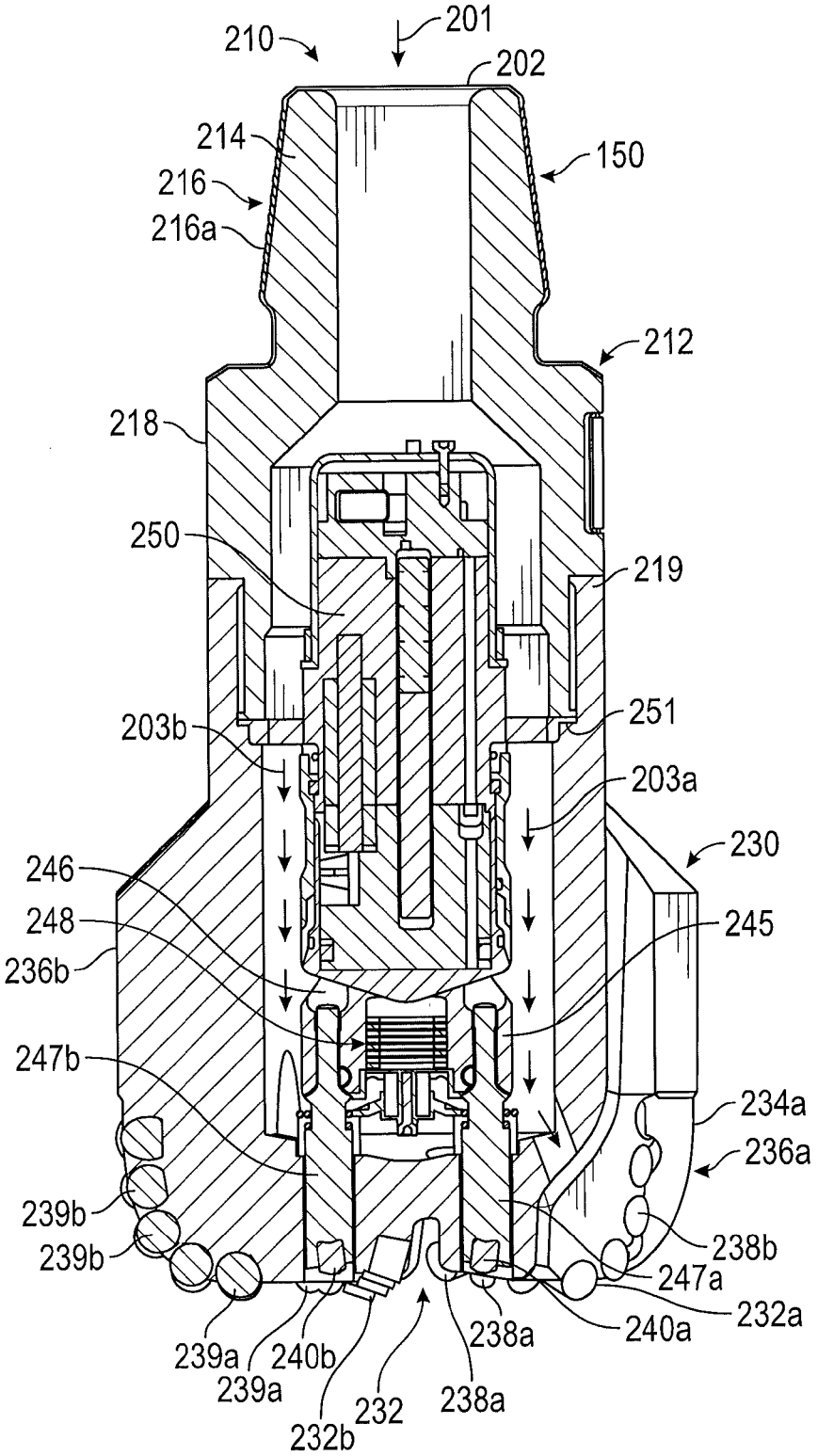
FIG. 2 shows a cross-section of an exemplary drill bit with a force application unit therein for extending and retracting pads on the surface of the drill bit.

FIG. 2 shows a cross-section of an exemplary drill bit 150 made according to one embodiment of the disclosure. The drill bit 150 shown is a polycrystalline diamond compact (PDC) bit having a bit body 210 that includes a shank 212 and a crown 230. The shank 212 includes a neck or neck section 214 that has a tapered threaded upper end 216 having threads 216*a* thereon for connecting the drill bit 150 to a box end at the end of the drilling assembly 130 (FIG. 1). The shank 212 has a lower vertical or straight section 218. The shank 210 is fixedly connected to the crown 230 at a connection joint 219. The crown 230 includes a face or face section 232 that faces the formation during drilling. The crown 230 includes a number of blades, such as blades 234*a* and 234*b*, each, each blade having a face section and a side section. For example, blade 234*a* has a face section 232*a* and a side section 236*a* while blade 234*b* has a face section 232*b* and a side section 236*b*. Each blade further includes a number of cutters. In the particular embodiment of FIG. 2, blade 234*a* is shown to include cutters 238*a* on the face section 232*a* and cutters 238*b* on the side section 236*a* while blade 234*b* is shown to include cutters 239*a* on face 232*b* and cutters 239*b* on the side section 236*b*. The drill bit 150 further includes one or more pads, such as pads 240*a* and 240*b*, each configured to extend and retract relative to the face 232. In one aspect, a rubbing block 245 may carry the pads 240*a* and 240*b*. In the particular configuration shown in FIG. 2, a rubbing block 245 is mounted inside the drill bit 150 and includes a rubbing block holder 246 having a pair of movable members 247*a* and 247*b*. The pad 240*a* is attached to the bottom of member 247*a* while pad 240*b* is attached at the bottom of the member 247*b*. A force application device 250 placed in the drill bit 150 causes the rubbing block 245 to move up and down, thereby extending and retracting the members 247*a* and 247*b* and thus the pads 240*a* and 24*b* relative to the bit face 232. In one configuration, the force application device may be made as a unit or module and attached to the drill bit inside via flange 251 at the shank bottom 217. A shock absorber 248, such as a spring unit, is provided to absorb shocks on the members 247*a* and 247*b* caused by the changing weight on the drill bit 150 during drilling of a wellbore. During drilling, a drilling fluid 201 flows from the drilling assembly into a fluid passage 202 in the center of the drill bit and discharges at the bottom of the drill bit via fluid passages, such as passages 203*a*, 203*b*, etc. A particular embodiment of a force application device 250 is described in more detail in reference to FIG. 3.

Figure 3:
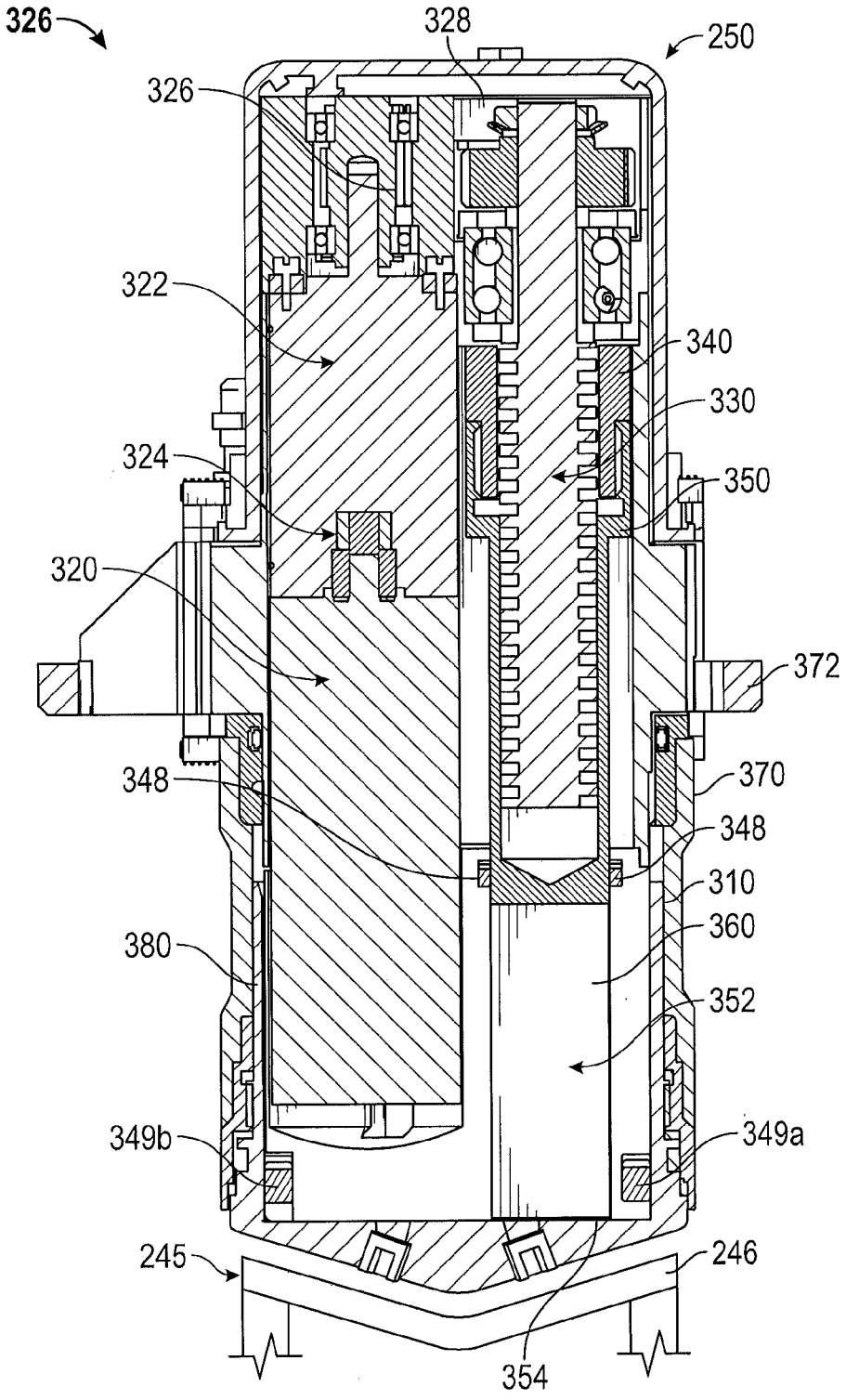
FIG. 3 shows certain details of an exemplary force application unit shown in FIG. 2.

FIG. 3 shows certain details of the force application device 250 according to one embodiment of the disclosure that may be utilized in the drill bit 150 shown in FIGS. 1-2. In the particular configuration of FIG. 3, the force application device 250 is made in the form of a unit or capsule that may be placed in the drill bit fluid channel 204, as shown in FIG. 2. The force application device 250 includes a expandable chamber 310 in contact with the rubbing block 245 that is configured to apply force on the rubbing block holder 246 in the downward direction to cause the pads 240*a* and 240*b* to extend from the drill bit surface 232, while removing the applied force on the rubbing block 245 causes the rubbing block to retract the pads from the drill bit surface, as described above in reference to FIG. 2. In one aspect, the force application device 250 includes a motor 320 connected to reduction gear 322 via a coupling member 324. In aspects, the motor 320 is an electric motor that may be a constant speed motor or variable speed motor. The operation of the motor may be controlled by a controller in the drill bit (not shown) and/or the controller 170 in the drilling assembly 130 (FIG. 1). The reduction gear 322 drives a gear 326 that in turn drives another gear 328. Gear 328 is connected to a drive screw 330.

Still referring to FIG. 3, when the drive screw 330 rotates in a first direction, for example clockwise, it drives a nut 340 mounted on the screw 330 downward, i.e. toward the chamber 310. The nut 340 moves a piston 350 downward, which in turn causes a fluid 352 in a chamber 310 to move downward. The fluid 352 expands into a fluid cavity 354 causing the cavity 354 to expand, which causes the chamber 310 to move downward. The expansion of the chamber 310 exerts a downward force on the rubbing block 245, thereby causing the pads 240*a* and 240*b* to extend (move outward) from the drill bit surface 232. Reversing the direction of the motor 320 (in this example counterclockwise) causes the screw 320 to rotate in the opposite direction (in this example anticlockwise), which causes the nut 340 to move upward (away from the rubbing block) causing the fluid in the cavity 354 to return to the chamber 310. That in turn releases the applied force on the rubbing block 245. The spring mechanism 248 causes the members 247*a* and 247*b* and hence the pads 240*a* and 240*b* to retract from the drill bit surface 232 (move upward) as described above in reference to FIG. 2. The chamber 310 is attached to bellows 370 that enable the chamber 310 to move axially downward when force is applied by the cavity 354 on the chamber 310 and enables the chamber 310 to move axially upward when the applied force on the cavity 354 is released from the chamber 310. Seal 348 provides a seal between the piston 350 and the fluid chamber 360. I addition, seal 349 provides a seal between the chamber 310 and the cavity 354. A suitable flange 372 is provided to connect the device 250 inside the drill bit 150 (FIG. 1).

Referring to FIGS. 2 and 3, to extend the pads 240*a* and 240*b* from the drill bit surface 232, the motor 320 is rotated in a first direction, which rotary motion moves a member 340 (nut) linearly in a first direction, that in turn hydraulically exerts a force on the rubbing block 245 that causes the pads 240*a* and 240*b* to extend from the drill bit surface 232. To retract the pads 240*a* and 240*b* from the drill bit surface 232, the motor 320 is rotated in a second direction (opposite to the first direction), which rotation causes the member 340 to move linearly in a second direction, which releases the applied hydraulic force on the rubbing block 245 and thus the pads. The biasing member 248 in the rubbing block causes the members 247*a* and 247*b* and thus the pads 240*a* and 240*b* to retract from the drill bit surface 232. A sensor 380 provides signals corresponding to the movement of the chamber 310, which signals may be utilized by a processor in the drill bit of in the drilling assembly to determine the extension or retraction of the pads from the drill bit surface. Such information may be used to control the operation of the motor 320 to adjust the extension of the pads 240*a* and 240*b*. The pad extension and retraction may be done by a downhole controller or a surface controller in response to one or more parameters of the drilling assembly, drilling parameters and formation parameters.

The concepts and embodiments described herein are useful to control the axial aggressiveness of drill bits, such as a PDC bits, on demand during drilling. Such drill bits aid in: (a) steerability of the bit (b) dampening the level of vibrations and (c) reducing the severity of stick-slip while drilling, among other aspects. Moving the pads up and down changes the drilling characteristic of the bit. The electrical power may be provided from batteries in the drill bit or a power unit in the drilling assembly. A controller may control the operation of the motor and thus the extension and retraction of the pads in response to a parameter of interest or an event, including but not limited to vibration levels, torsional oscillations, high torque values; stick slip, and lateral movement.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a surface that includes a pad configured to extend and retract from the surface;

a motor;

a linearly movable member coupled to the motor;

a hydraulic unit configured to apply force on the pad wherein rotation of the motor in a first rotational direction causes the linearly movable member in a first direction to cause the hydraulic unit to exert a force on the pad to extend the pad; and a piston coupled to the linearly movable member, wherein the movement of the linearly movable member moves the piston in the first direction, and the hydraulic unit includes a fluid chamber and a chamber coupled to the pad and wherein the movement of the piston in the first direction compresses a fluid in the fluid chamber that in turn exerts pressure on the chamber to cause the chamber to move in the first direction.

2. The drill bit of claim 1 further comprising a screw member coupled to the motor and wherein the motor rotates the screw member that in turn moves the linearly movable member in the first direction.

3. The drill of claim 1, wherein the linearly movable member is a nut riding on a screw member.

4. The drill bit of claim 1 further comprising a bellows coupled to the chamber configured to allow the chamber to move in the first direction.

5. The drill bit of claim 1, wherein rotating the motor in a second direction causes the linearly movable member to move in a second direction to release the force applied on the chamber.

6. The drill bit of claim 5 further comprising a biasing member coupled to the chamber configured to move the pad in the second direction when the force applied is released.

7. The drill bit of claim 1, wherein the drill bit includes a fluid passage and wherein the hydraulic unit is placed in the fluid passage.

8. The drill bit of claim 1 further comprising a shock absorber configured to absorb shocks relating to weight on bit during drilling a drilling operation.

9. A drilling apparatus, comprising:

a drilling assembly having at least one sensor for determining a property of interest downhole;

a drill bit attached to the drilling assembly for drilling a wellbore, the drill bit comprising:

a pad configured to extend and retract from a face of the drill bit;

a motor;

a linearly movable member coupled to the motor;

a hydraulic unit configured to apply force on the pad wherein, rotation of the motor in a first rotational direction causes the linearly movable member in a first direction to cause the hydraulic unit to exert a force on the pad to extend the pad; and a piston coupled to the linearly movable member and wherein the movement of the linearly movable member moves the piston along the first direction and the hydraulic unit includes a fluid chamber and a chamber coupled to the pad and wherein the movement of the piston in the first direction compresses a fluid in the fluid chamber that in turn exerts pressure on the chamber to cause the chamber to move in the first direction.

10. The drilling apparatus of claim 9, wherein the drill bit further comprises a screw member coupled to the motor and wherein the motor rotates the screw member that in turn moves the linearly movable member in the first direction.

11. The drilling apparatus of claim 9, wherein the drill bit further comprises a bellows coupled to the chamber configured to allow the chamber to move in the first direction.

12. The drilling apparatus of claim 9, wherein rotating the motor in a second direction causes the linearly movable member to move in a second direction to release the force applied on the chamber.

* * * * *